US008297152B2

(12) United States Patent
Hu

(10) Patent No.: US 8,297,152 B2
(45) Date of Patent: Oct. 30, 2012

(54) RATCHET WRENCH

(76) Inventor: Bobby Hu, Taichung (TW)

( * ) Notice: Subject to any disclaimer, the term of this patent is extended or adjusted under 35 U.S.C. 154(b) by 338 days.

(21) Appl. No.: 12/843,942

(22) Filed: Jul. 27, 2010

(65) Prior Publication Data

US 2011/0107879 A1 May 12, 2011

(30) Foreign Application Priority Data

Nov. 6, 2009 (TW) ..... 98137748 A
Feb. 5, 2010 (CN) ..... 2010 1 0111836

(51) Int. Cl.
*B25B 13/46* (2006.01)

(52) U.S. Cl. ..... 81/63.1; 81/63.2

(58) Field of Classification Search ..... 81/60–63.2
See application file for complete search history.

(56) References Cited

U.S. PATENT DOCUMENTS 6,431,031 B1 * 8/2002 Hu ..... 81/63.2
6,457,387 B1 * 10/2002 Hu ..... 81/63.2
6,568,299 B2 * 5/2003 Hu ..... 81/63.2
6,805,028 B1 * 10/2004 Chang ..... 81/63.2
6,966,241 B2 * 11/2005 Huang ..... 81/63.2
7,210,380 B1 * 5/2007 Wu ..... 81/63.2
7,278,339 B2 10/2007 Hu ..... 81/63.2
7,328,633 B2 * 2/2008 Lin ..... 81/63.1
7,827,886 B2 * 11/2010 Hu ..... 81/63.1

* cited by examiner

*Primary Examiner* — Alicia Torres
(74) *Attorney, Agent, or Firm* — Alan Kamrath; Kamrath IP Lawfirm, PA

(57) ABSTRACT

A ratchet wrench includes a head having a compartment rotatably receiving a drive member. A pawl groove is formed in an inner periphery of compartment and slideably receives a pawl. A switch is received in a switch groove in the head and pivotable about a pivoting axis. A control member is movable between two positions to control engagement between the pawl and the drive member through sliding movement of a guide of the switch in a control groove in the control member. The guide of the switch contacts the contact groove at a contact point when the control member is in either operative position. A tangent to an outer surface of the guide at the contact point has an angle not larger than 45° relative to a reference line extending perpendicularly to the pivoting axis and intersecting a longitudinal axis of the guide.

15 Claims, 13 Drawing Sheets

RATCHET WRENCH

BACKGROUND OF THE INVENTION

The present invention relates to a ratchet wrench and, more particularly, to a ratchet wrench providing direct and reliable actuation for moving a pawl while reducing the manufacturing costs.

U.S. Pat. No. 7,278,339 discloses a reversible ratchet wrench including a head rotatably receiving a drive member. A pawl is slideably received in the head between two positions and releasably engages with the drive member. A ring is mounted around an end of the drive member and includes a tip piece having a slot. A reversing plate is pivotably mounted to the end of the drive member and operatively connected to the ring to turn therewith. A switching member is pivotably received in a receiving hole of the head and includes a protrusion engaged in the slot of the tip piece of the ring such that the switching member is pivoted when the ring is pivoted. The switching member includes a receptacle receiving an elastic element and a pressing member biased by the elastic element to press against the pawl. The reversing plate is pivotable between two operative positions to move the pawl between the two positions to switch the driving direction of the ratchet wrench. However, friction between the ring and the reversing plate causes wear and generates scraps between the ring and the reversing plate. Furthermore, a positioning structure including a pin and a pin hole is required for positioning the reversing plate, leading to an increase in the manufacturing costs as well as adverse affect in the positioning effect due to accumulation of dust in the gaps between the positioning elements. Further, there are many elements between the reversing plate and the switching member with each element having its own play, leading to insensitive driving direction-switching operation. Further, a user may work with his or her head facing upward in some cases. Direction-switching operation may be a problem in these cases when a socket or an extension is coupled to a drive column of the drive member that faces upward, because gravitational force is imparted to the drive member from the socket, the extension or even the object to be the rotated by the ratchet wrench. The user has to remove the socket or extension from the drive column, flip the drive member so that the drive column faces downward, switch the driving direction, and reattach the socket or extension to the drive column, which is extremely inconvenient and inefficient.

Thus, a need exists for a ratchet wrench providing direct and reliable actuation for moving a pawl while reducing the manufacturing costs.

BRIEF SUMMARY OF THE INVENTION

The present invention solves this need and other problems in the field of direct transmission between elements of ratchet wrenches by providing, in a preferred form, a ratchet wrench including a head and a handle interconnected to the head. The head includes a compartment having a first longitudinal axis. A pawl groove is defined in an inner periphery of the compartment. The head further includes a switch groove in communication with the pawl groove. The switch groove has a second longitudinal axis parallel to and spaced from the first longitudinal axis of the compartment. A first reference line extends from the compartment towards the switch groove. The first reference line extends perpendicularly to the first longitudinal axis of the compartment and intersects the second longitudinal axis of the switch groove. A drive member is rotatably received in the compartment about a rotating axis coincident to the first longitudinal axis of the compartment. The drive member includes a coupling section. A pawl is slideably received in the pawl groove between first and second positions respectively in first and second engagement relationships with the coupling section of the drive member. A switch includes a pivotal end rotatably received in the switch groove about a first pivoting axis coincident to the second longitudinal axis of the switch groove to control the first and second engagement relationships between the pawl and the coupling section of the drive member. The switch further includes an actuation end having a guide spaced from the first pivoting axis of the switch in a radial direction perpendicular to the first pivoting axis. The guide has a third longitudinal axis parallel to and spaced from the first pivoting axis. A second reference line extends from the actuation end towards the guide. The second reference line extends perpendicularly to the first pivoting axis and intersects the third longitudinal axis of the guide. A control member includes a pivotal portion rotatable relative to the head and pivotable between first and second operative positions about a second pivoting axis coincident to the rotating axis. The control member further includes a control groove spaced from the second pivoting axis in a length direction of the control member perpendicular to the second pivoting axis. The guide of the switch is slideably received in the control groove. The first and second engagement relationship between the pawl and the coupling section of the drive member are controlled by moving the control member between the first and second operative positions through sliding movement of the guide in the control groove that causes pivotal movement of the switch about the first pivoting axis. The control member defines a third reference line extending from the pivotal portion towards the control groove. The third reference line extends perpendicularly to the second pivoting axis of the control member and passes through a center of the control groove. The control groove includes first and second actuating portions on opposite sides of the third reference line.

When the control member is in the first operative position, the pawl is in the first engagement relationship with the coupling section of the drive member, allowing the handle and the drive member to rotate in a first direction driving an object in the first direction, and allowing the handle to rotate freely relative to the drive member in a second direction reverse to the first direction without driving the object. The guide of the switch has an outer surface contacting the first actuating portion at a first contact point. A first tangent to the outer surface of the guide at the first contact point has a first angle not larger than 45° relative to the second reference line.

When the control member is in the second operative position, the pawl is in the second engagement relationship with the coupling section of the drive member, allowing the handle and the drive member to rotate in the second direction driving the object in the second direction, and allowing the handle to rotate freely relative to the drive member in the first direction without driving the object. The outer surface of the guide of the switch contacts the second actuating portion at a second contact point. A second tangent to the outer surface of the guide at the second contact point has a second angle not larger than 45° relative to the second reference line.

In a preferred form, the first and second actuating portions are symmetric to each other relative to the third reference line. The first actuating portion includes a rectilinear first section and an arcuate second section contiguous to the first section. The first section has a first spacing to the second pivoting axis along the third reference line larger than the second section. The second actuating portion includes a rectilinear third section and an arcuate fourth section contiguous to the third section. The third section has a second spacing to the second pivoting axis along the third reference line larger than the fourth section. The first contact point is located between the first section of the first actuating portion and the guide of the switch when the control member is in the first operative position. The second contact point is located between the third section of the second actuating portion and the guide of the switch when the control member is in the second operative position. The first and third sections have decreasing spacings therebetween away from the second pivoting axis. The second and fourth sections have decreasing spacings therebetween away from the second pivoting axis. The spacings between the first and third sections are smaller than the spacings between the second and fourth sections.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
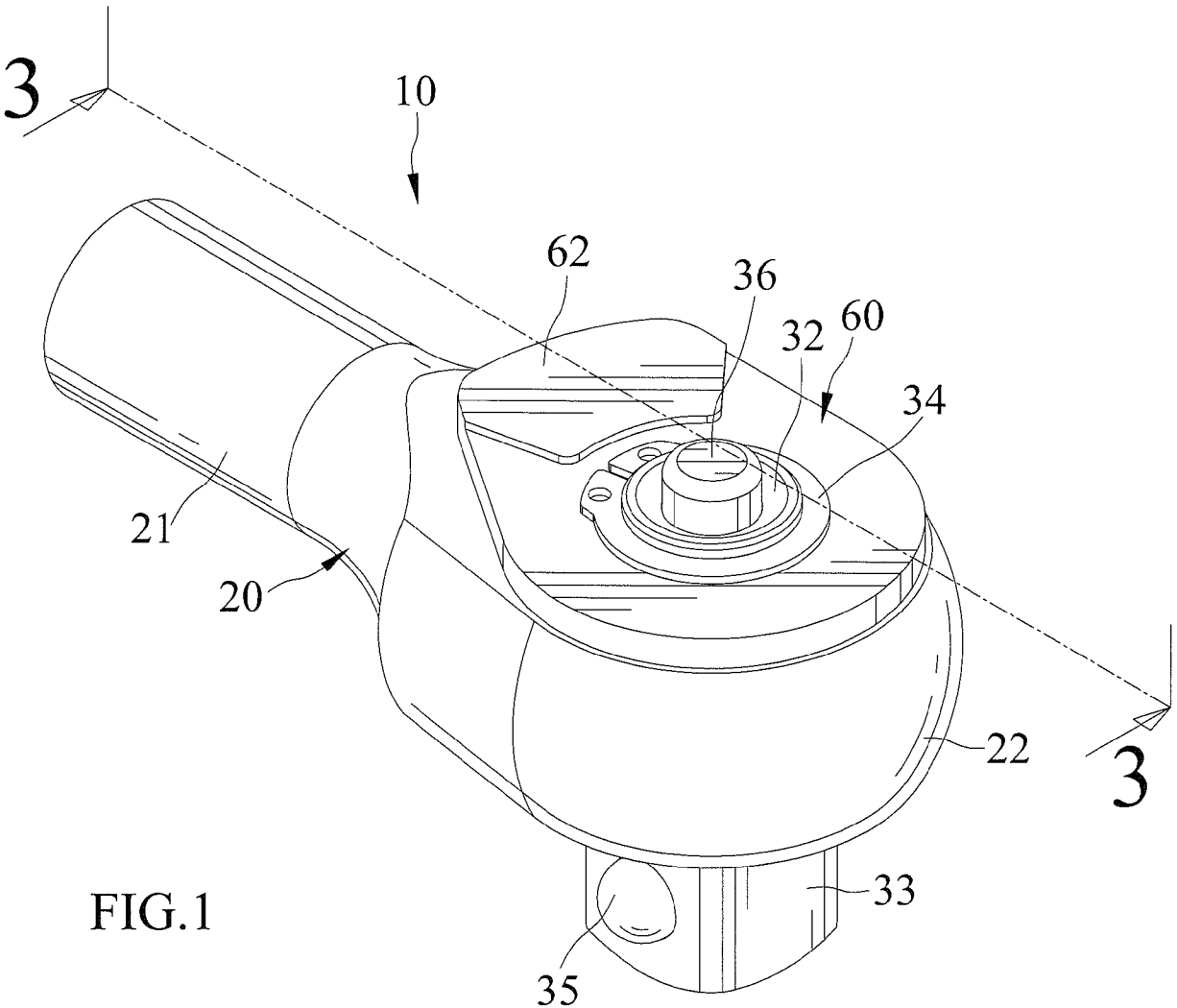
FIG. 1 shows a partial, perspective view of a ratchet wrench of a first embodiment according to the preferred teachings of the present invention.
Figure 2:
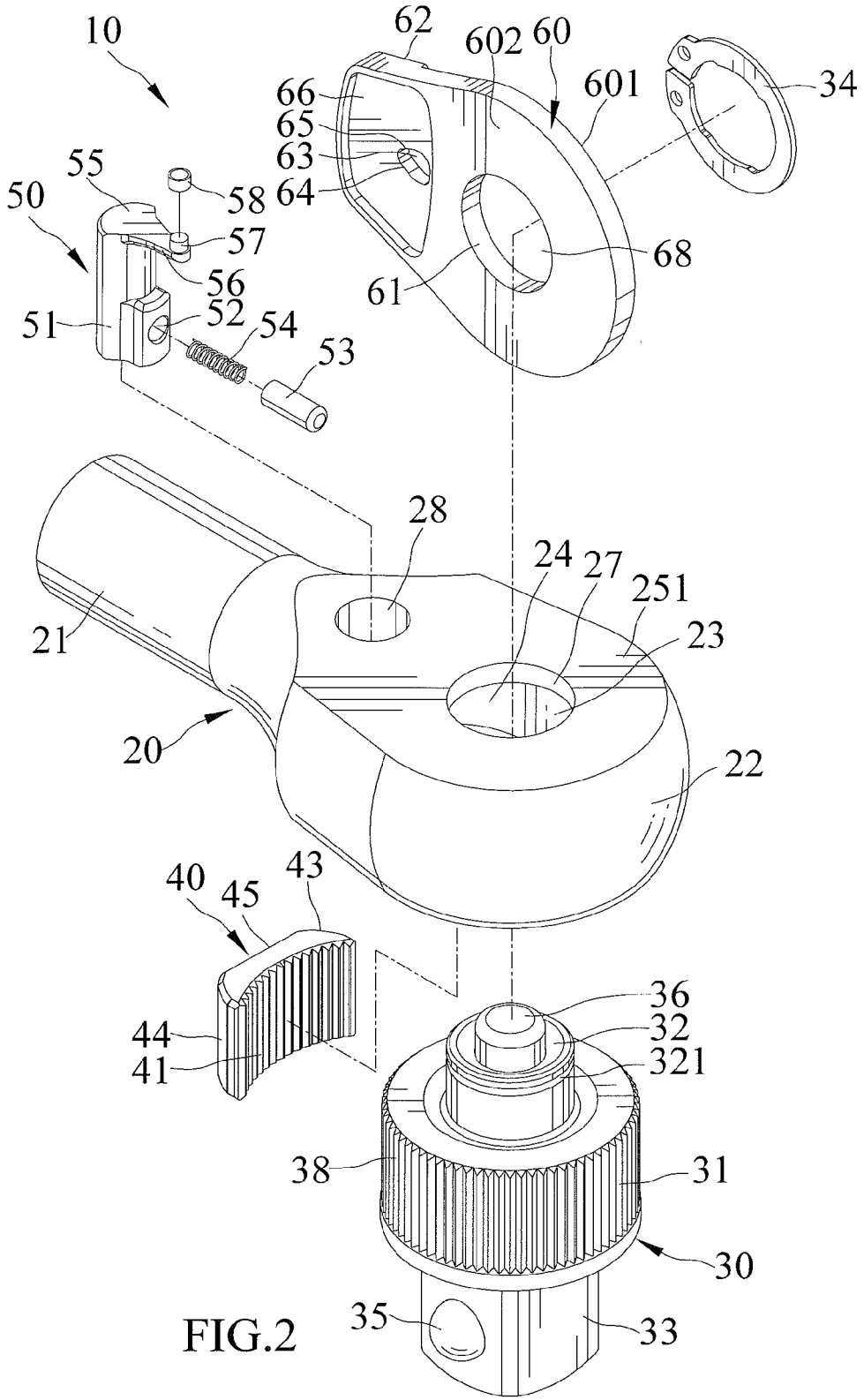
FIG. 2 shows a partial, exploded, perspective view of the ratchet wrench of FIG. 1.
Figure 3:
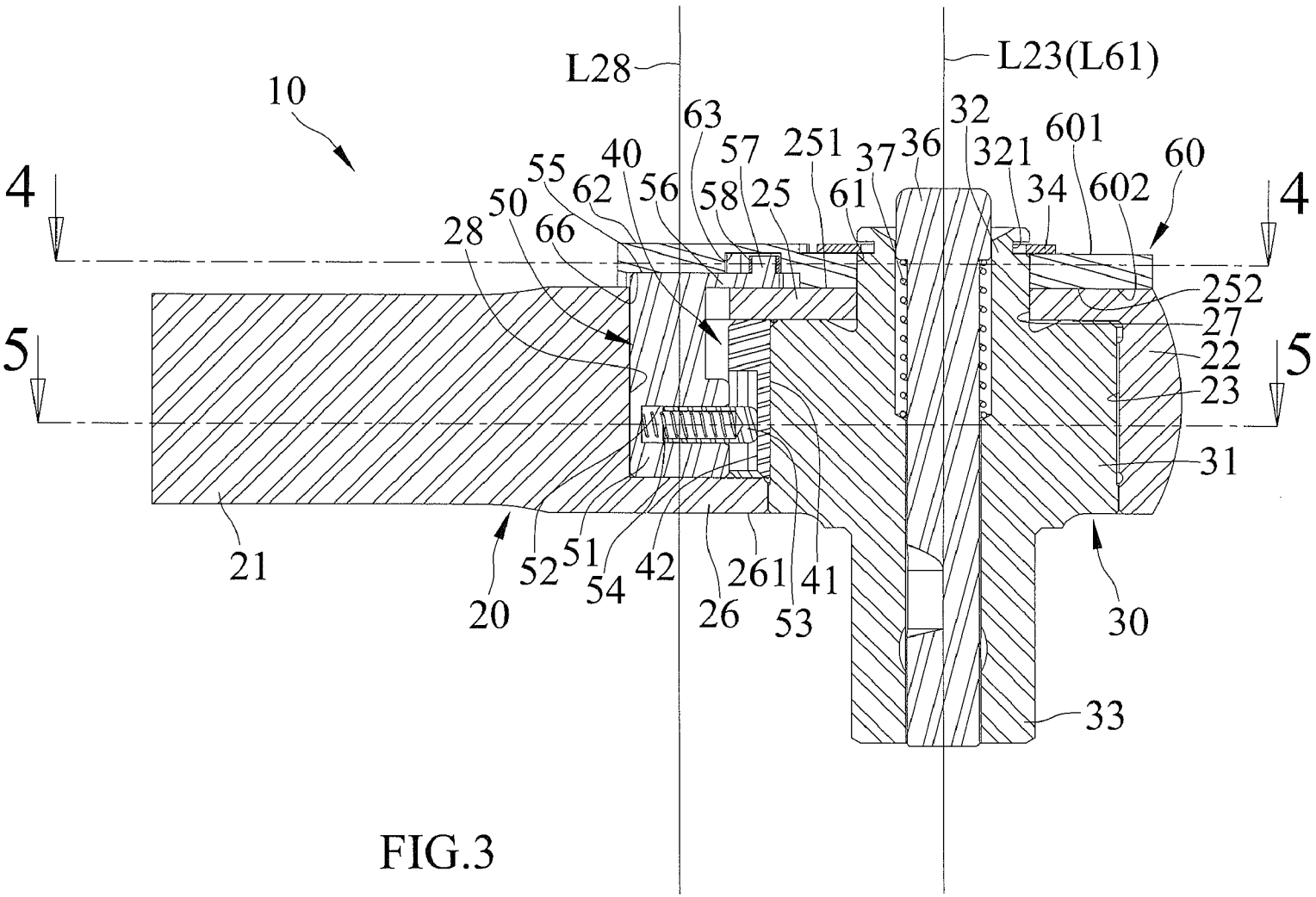
FIG. 3 shows a partial, cross sectional view of the ratchet wrench of FIG. 1 according to section line 3-3 of FIG. 1.
Figure 4:
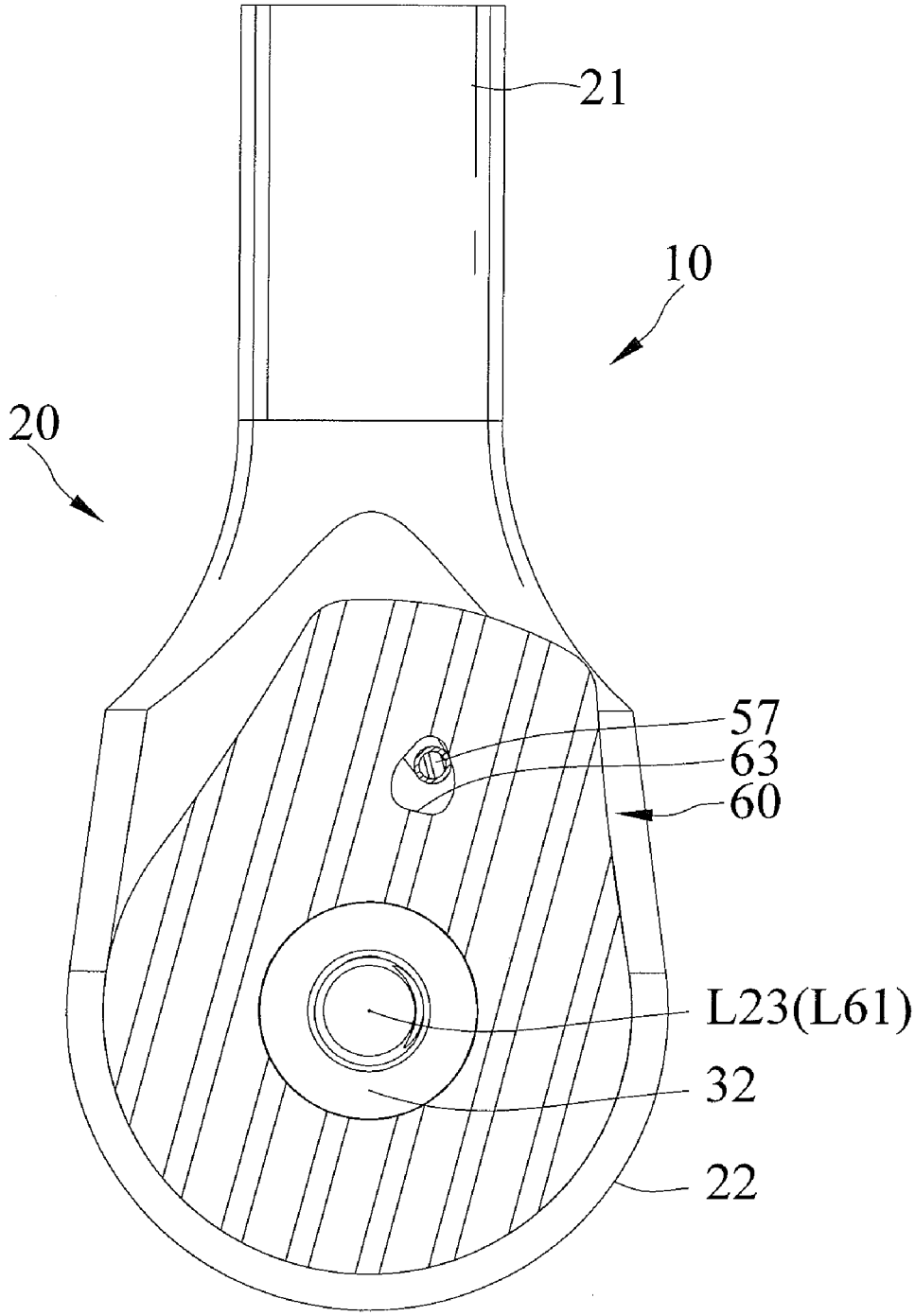
FIG. 4 shows a partial, cross sectional view of the ratchet wrench of FIG. 1 according to section line 4-4 of FIG. 3 with a control member of the ratchet wrench in a first operative position.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "outer", "side", "end", "portion", "section", "longitudinal", "clockwise", "counterclockwise", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 10. In preferred forms shown in FIGS. 1-13, ratchet wrench 10 includes a body 20 having a head 22 and a handle 21 interconnected to head 22. Head 22 includes first and second sides 25 and 26. A compartment 23 extends from second side 26 towards but spaced from first side 25. Compartment 23 is circular in cross section and defines a longitudinal axis L23. First and second sides 25 and 26 are spaced along longitudinal axis L23. A pawl groove 24 is formed in an inner periphery of compartment 23 and is crescent in cross section. First side 25 includes parallel, spaced inner and outer surfaces 252 and 251 spaced along longitudinal axis L23. Compartment 23 is delimited by inner surface 252. First side 25 further includes a hole 27 in communication with and coaxial to compartment 23. Hole 27 has a diameter smaller than compartment 23. First side 25 further includes a switch groove 28 in communication with an end of pawl groove 24 opposite to the other end of pawl groove 24 contiguous to compartment 23. Switch groove 28 has a longitudinal axis L28 parallel to and spaced from longitudinal axis L23 of compartment 23. A first reference line C1 extends from compartment 23 towards switch groove 28. First reference line C1 extends perpendicularly to longitudinal axis L23 and intersects longitudinal axis L28. Switch groove 28 is spaced from hole 27 along first reference line C1 along which handle 21 extends. Second side 26 has an outer surface 261 parallel to and spaced from outer surface 251 of first side 25.

In the preferred forms shown in FIGS. 1-13, ratchet wrench 10 further includes a drive member 30 rotatably received in compartment 23 about a rotating axis coincident to longitudinal axis L23 of compartment 23. Drive member 30 includes a coupling section 31 having a plurality of teeth 38 in an outer periphery thereof. An engaging portion 32 extends from an end of coupling section 31 beyond head 22 via hole 27 and includes an annular groove 321 in a distal end thereof. A drive column 33 extends from the other end of coupling section 31 beyond second side 26 of head 22. Drive column 33 includes a hole receiving a ball 35. Drive member 30 further includes a central through-hole extending from engaging portion 32 through drive column 33 and in communication with the hole of drive column 33. A pushpin 36 is extended through the central through-hole and can be pushed to allow movement of ball 35 in the hole of drive column 33 for disengaging drive column 33 from a socket or the like. A spring 37 is provided to return push pin 36. Drive member 30 of other forms and types can be utilized according to the teachings of the present invention.

In the preferred forms shown in FIGS. 1-13, ratchet wrench 10 further includes a pawl 40 slideably received in pawl groove 24. Pawl 40 includes an inner, toothed face 41 releasably engaged with teeth 38 of drive member 30. Inner, toothed face 41 is arcuate and provides a secure meshing effect with teeth 38 of drive member 30, increasing the torque provided by ratchet wrench 10. Pawl 40 includes an outer face 45 opposite to inner, toothed face 41 and facing away from drive member 30. Outer face 45 includes a recessed portion 42. Pawl 40 further includes first and second sliding faces 43 and 44 on opposite sides of outer face 45 for selectively abutting with an inner periphery of pawl groove 24. However, pawl 40 of other forms and types can be utilized according to the teachings of the present invention.

In the preferred forms shown in FIGS. 1-13, ratchet wrench 10 further includes a switch 50 having a pivotal end 51 rotatably received in switch groove 28. Pivotal end 51 defines a pivoting axis coincident to longitudinal axis L28 of switch groove 28. Pivotal end 51 includes a receptacle 52 at a portion adjacent to pawl 40 and extending perpendicularly to the pivoting axis of switch 50. A pressing member 53 and an elastic element 54 are received in receptacle 52. Pressing member 53 is biased by elastic element 54 to press against recessed portion 42 of pawl 40 for controlling engagement between pawl 40 and drive member 30. Pressing member 53 is in the form of a hollow pin, and elastic element 54 is in the form of a spring. However, pressing member 53 and elastic element 54 can be of other forms and types according to the teachings of the present invention.

In the preferred forms shown in FIGS. 1-13, switch 50 further includes an actuation end 55 extending beyond outer surface 251 of first side 25. Actuation end 55 includes an extension 56 located outside of switch groove 28 and extending towards compartment 23 in a radial direction perpendicular to the pivoting axis of pivotal end 51. A guide 57 includes a cylindrical peg formed on a distal end of extension 56 and has a longitudinal axis spaced from the pivoting axis of pivotal end 51 (also the pivoting axis of switch 50) in the radial direction. Guide 57 can further include a ring 58 rotatably mounted around the peg and serving as a bearing. The longitudinal axis of guide 57 is parallel to the pivoting axis of switch 50. Switch 50 defines a second reference line C2 extending from actuation end 55 towards guide 57. Second reference line C2 extends perpendicularly to the pivoting axis of switch 50 and intersects the longitudinal axis of guide 57. Furthermore, switch 50 further includes a positioning portion 551 in the form of a cylindrical stub coaxially extending from pivotal end 51 along the pivoting axis of switch 50.

In the preferred forms shown in FIGS. 1-13, ratchet wrench 10 further includes a control member 60 having a pivotal portion 61 and an operative portion 62 spaced from pivotal portion 61 in a length direction of control member 60. Control member 60 further includes inner and outer faces 602 and 601 extending between pivotal portion 61 and operative portion 62. Inner face 602 is intermediate outer surface 601 and head 22 along the rotation axis of drive member 30. Pivotal portion 61 of control member 60 includes a hole 68 defining a pivoting axis L61 perpendicular to the length direction and coincident to longitudinal axis L23 of compartment 23 of body 20. Pivotal portion 61 of control member 60 is rotatably mounted around a portion of engaging portion 32 of drive member 30 beyond first side 25 of head 22. A retainer ring 34 is engaged in annular groove 321 of engaging portion 32 and rests on top of control member 60 to prevent drive member 30 and control member 60 from disengaging from head 22 while allowing rotational movement of control member 60. Control member 60 is pivotable between first and second operative positions about pivoting axis L61 and coincident to the rotating axis of drive member 30. Operative portion 62 of control member 60 is adapted to be manually operated to control movement of control member 60 between the first and second operative positions.

In the preferred forms shown in FIGS. 1-13, a recess 66 is formed in inner face 601 of control member 60 and has a bottom face. Actuation end 55 of switch 50 is received in recess 66. A control groove 63 is formed in the bottom face of recess 66 and has a shape like a tumbler or teardrop. A third reference line C3 extends from pivotal portion 61 of control member 60 towards control groove 63. Third reference line C3 extends perpendicularly to pivoting axis L61 of control member 60 and passes through a center of control groove 63. Third reference line C3 extends towards an end of head 22 having switch groove 28. Third reference line C3 is a dividing line of control groove 63. Namely, control groove 63 includes two portions symmetric to each other relative to third reference line C3. Control groove 63 includes symmetric first and second actuating portions 64 and 65 respectively on the two portions on opposite side of third reference line C3. First actuating portion 64 includes a rectilinear first section 631 and an arcuate second section 632 contiguous to first section 631. First section 631 has a spacing to pivoting axis L61 of pivotal portion 61 of control member 60 along third reference line C3 larger than second section 632. Ring 58 of guide 57 is rollable along first and second sections 631 and 632 and serves as a bearing to reduce frictional interaction. When control member 60 is in the first operative position, a tangent T to an outer surface of guide 57 at a contact point between first section 631 and ring 58 of guide 57 has an angle θ not larger than 45° and preferably in a range of 18°-28° relative to second reference line C2. Likewise, second actuating portion 65 includes a rectilinear third section 633 and an arcuate fourth section 634 contiguous to third section 633. Third section 633 has a spacing to pivoting axis L61 of pivotal portion 61 of control member 60 along third reference line C3 larger than fourth section 634. When control member 60 is in the second operative position, a tangent T to the outer surface of guide 57 at a contact point between third section 633 and ring 58 of guide 57 has an angle θ not larger than 45° and preferably in a range of 18°-28° relative to second reference line C2. First and third sections 631 and 633 have decreasing spacings therebetween away from pivoting axis L61 of control member 60. Second and fourth sections 632 and 634 have decreasing spacings therebetween away from pivoting axis L61 of control member 60. This allows the user to easily and rapidly actuate operative portion 62 of control member 60 for moving control member 60 between the first and second operative positions under guidance of control groove 63.

Figure 11:
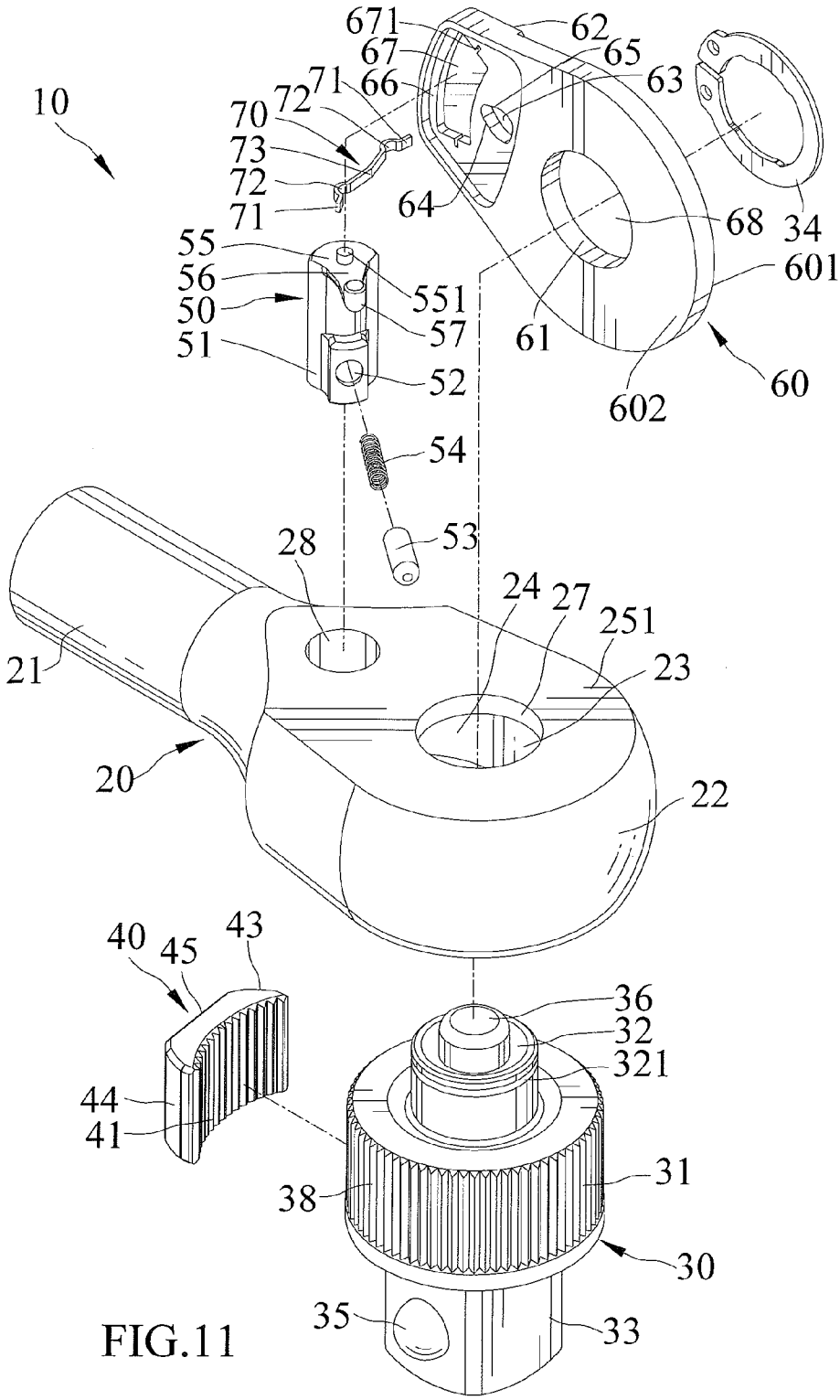
FIG. 11 shows a partial, exploded, perspective view of a ratchet wrench of a second embodiment according to the preferred teachings of the present invention.
Figure 12:
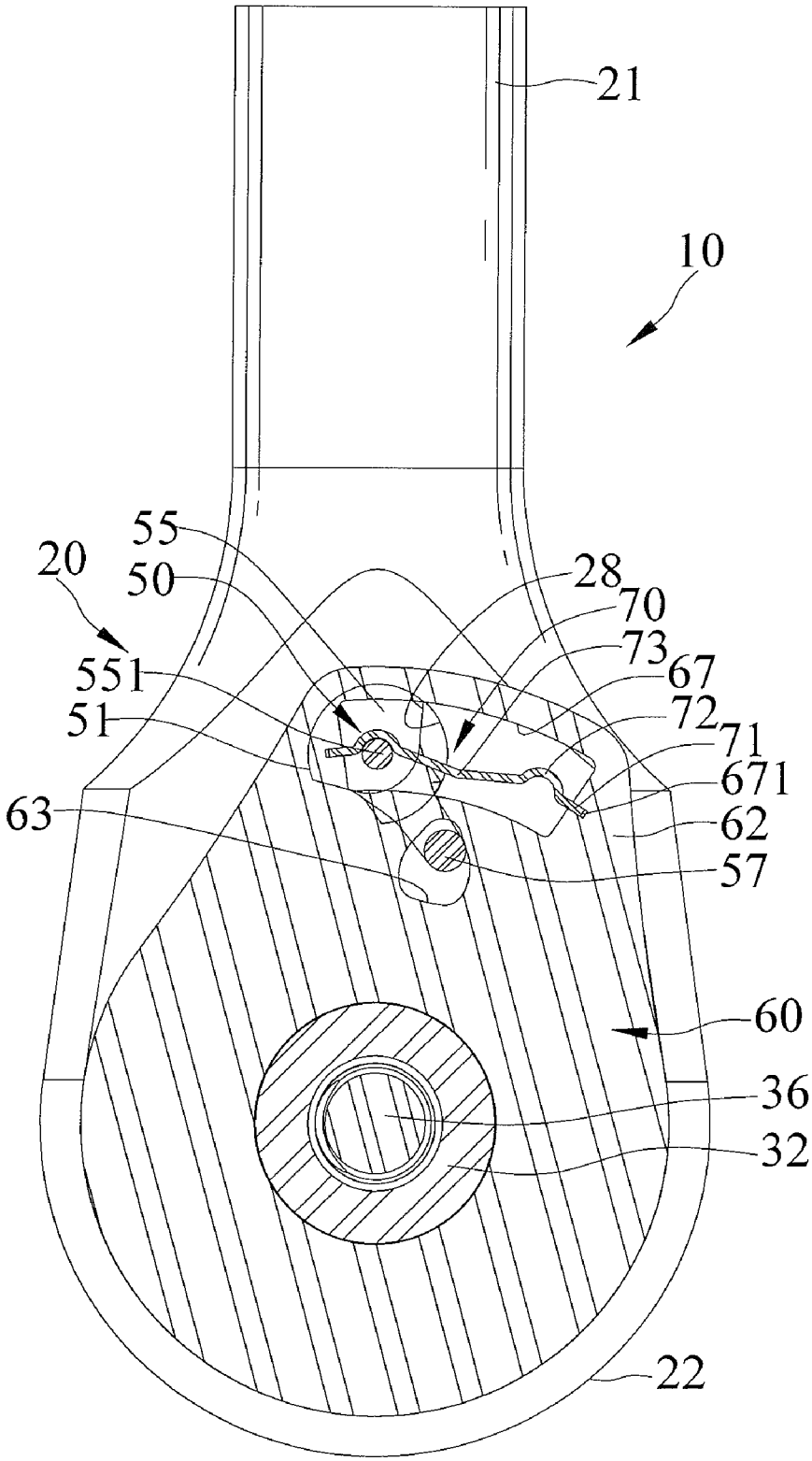
FIG. 12 shows a partial, cross sectional view of the ratchet wrench of FIG. 11 with a control member of the ratchet wrench in a first operative position.
Figure 13:
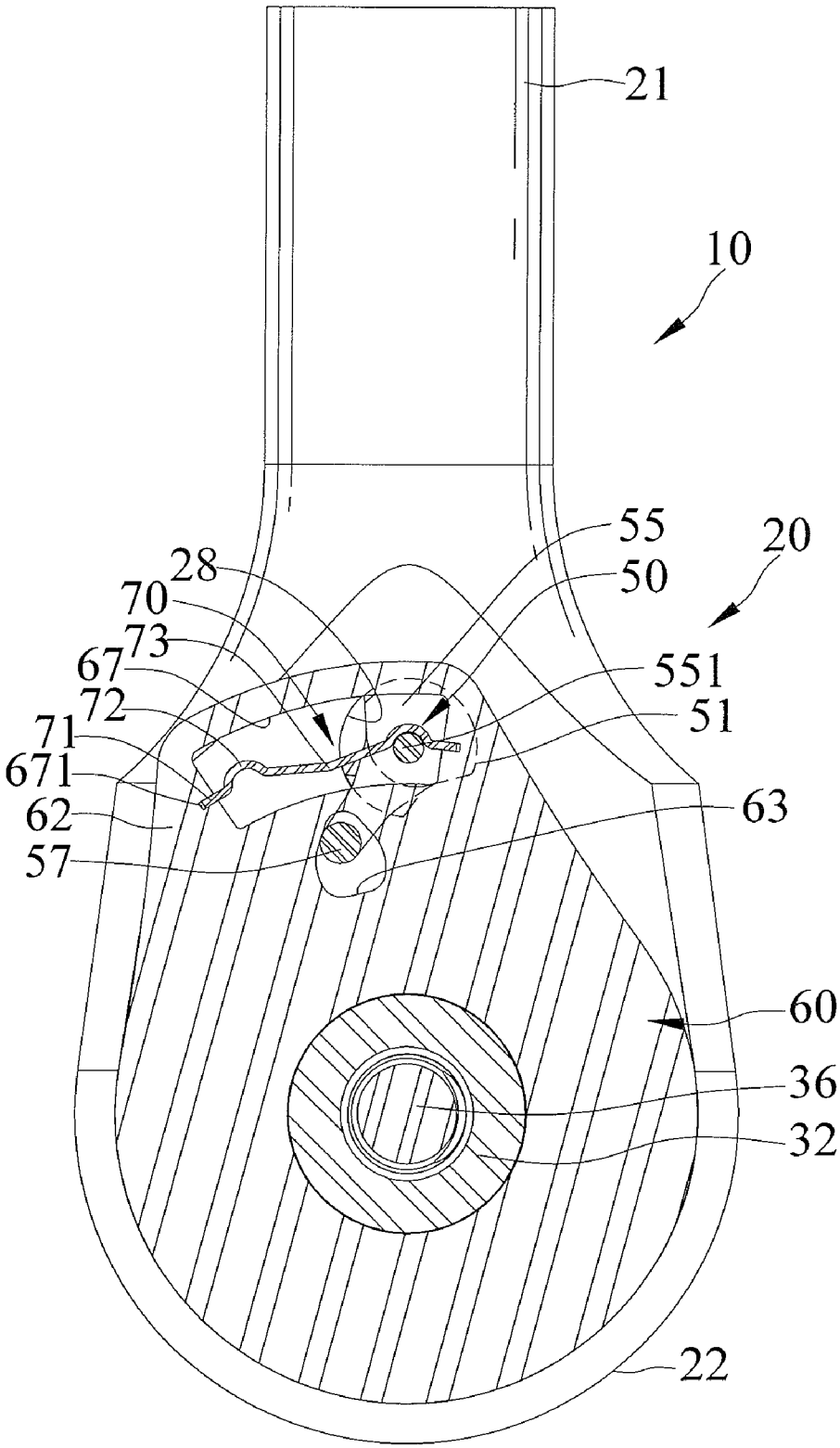
FIG. 13 shows a partial, cross sectional view of the ratchet wrench of FIG. 11 with the control member in a second operative position.

In the preferred form shown in FIGS. 11-13, a retaining groove 67 is formed in the bottom face of recess 66. Control groove 63 is intermediate pivoting axis L61 and retaining groove 67 in the length direction of control member 60. Retaining groove 67 includes two sidewalls each having a notch 671. A positioning member 70 in the form of a resilient metal strip is received in retaining groove 67. Positioning member 70 includes two ends 71 engaged in notches 671. Positioning member 70 further includes arcuate first and second positioning grooves 72 in a side thereof. First and second positioning grooves 72 are semi-circular in cross section in the preferred forms shown in FIGS. 11-13 and are intermediate ends 71. Positioning portion 551 of switch 50 is selectively received in one of first and second positioning grooves 72. Positioning member 70 further includes a substantially V-shaped returning portion 73 intermediate first and second positioning grooves 72. Returning portion 73 has a spacing to pivoting axis L61 of pivotal portion 61 in the length direction of control member 60 smaller than positioning grooves 72. Positioning portion 551 of switch 50 is urged by returning portion 73 into one of positioning grooves 72 when positioning portion 551 is on returning portion 73.

Figure 5:
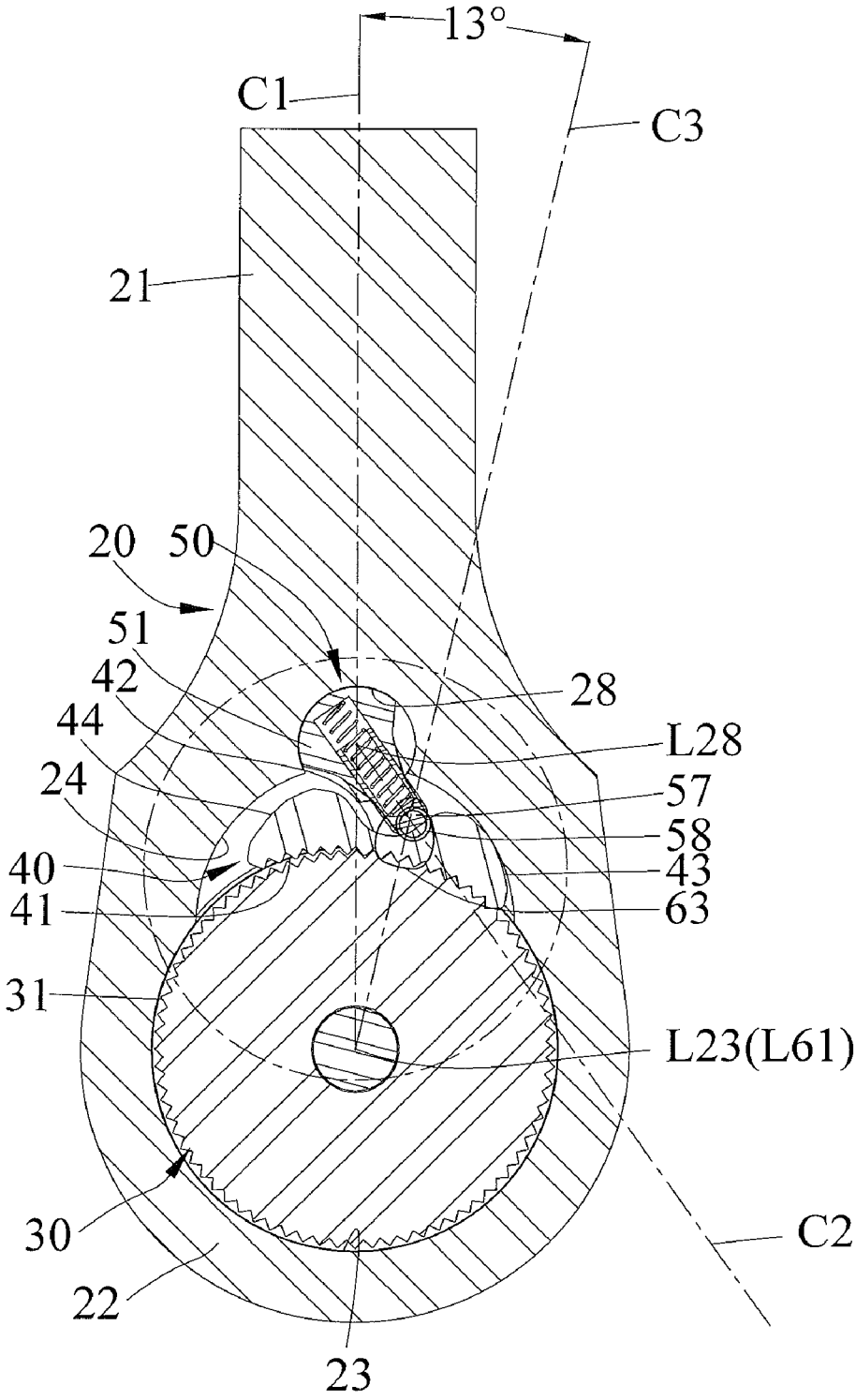
FIG. 5 shows a partial, cross sectional view of the ratchet wrench of FIG. 1 according to section line 5-5 of FIG. 3 with the control member in the first operative position.
Figure 6:
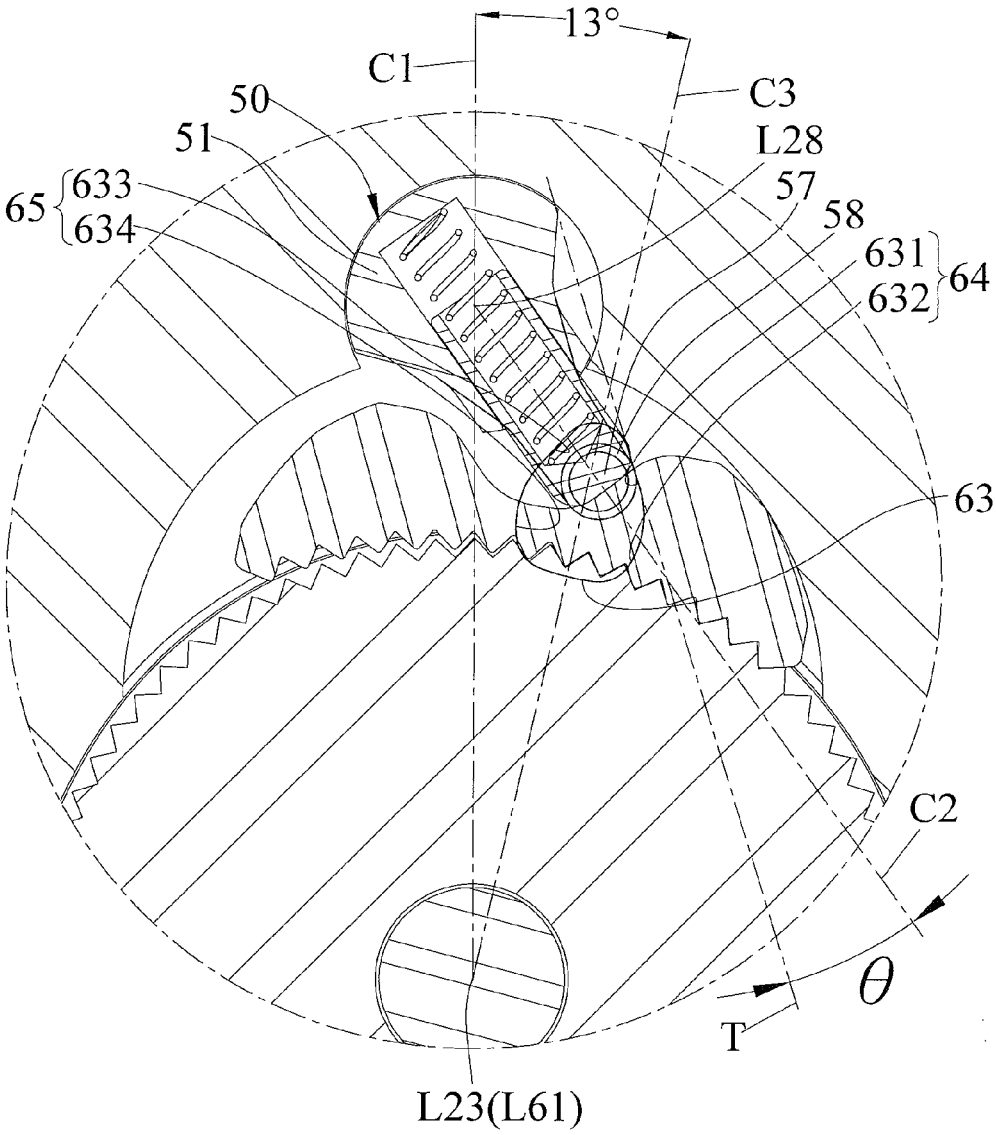
FIG. 6 shows an enlarged view of a portion of the ratchet wrench of FIG. 5.

Now that the basic construction of ratchet wrench 10 of the preferred teachings of the present invention has been explained, the operation and some of the advantages of ratchet wrench 10 can be set forth and appreciated. Operation of ratchet wrench 10 of FIGS. 1-10 will firstly be described. In particular, for the sake of explanation, it will be assumed that control member 50 is initially in the first operative position (FIGS. 5 and 6). Pressing member 53 presses against a side of recessed portion 42 of pawl 40 under the action of elastic element 54. Pawl 40 is in a first engagement relationship with teeth 38 of drive member 30. Specifically, a portion of inner, toothed face 41 of pawl 40 is engaged with teeth 38 of drive member 30, and the other portion of inner, toothed face 41 of pawl 40 is disengaged from teeth 38 of drive member 30. In this state, handle 21 and drive member 30 can rotate jointly in the counterclockwise direction relative to body 20 to drive an object such as a fastener in the counterclockwise direction. Furthermore, handle 21 can rotate freely in the clockwise direction relative to drive member 30 without driving the object. Third reference line C3 has an angle in the order of 13° relative to first reference line C1. Angle θ between second reference line C2 and tangent T to the outer surface of guide 57 at the contact point between first section 631 and ring 58 of guide 57 is not larger than 45°.

When the user is intended to move control member 50 from the first operative position to the second operative position (FIG. 10), most part of the force applied to control member 60 is imparted to guide 57 of switch 50 to cause rotation of switch 50 in switch groove 28 without the risk of getting stuck or non-smooth movement of control member 60 and switch 50. Thus, the user can easily move operative portion 62 of control member 60, and switch 50 is moved by control groove 63.

Figure 7:
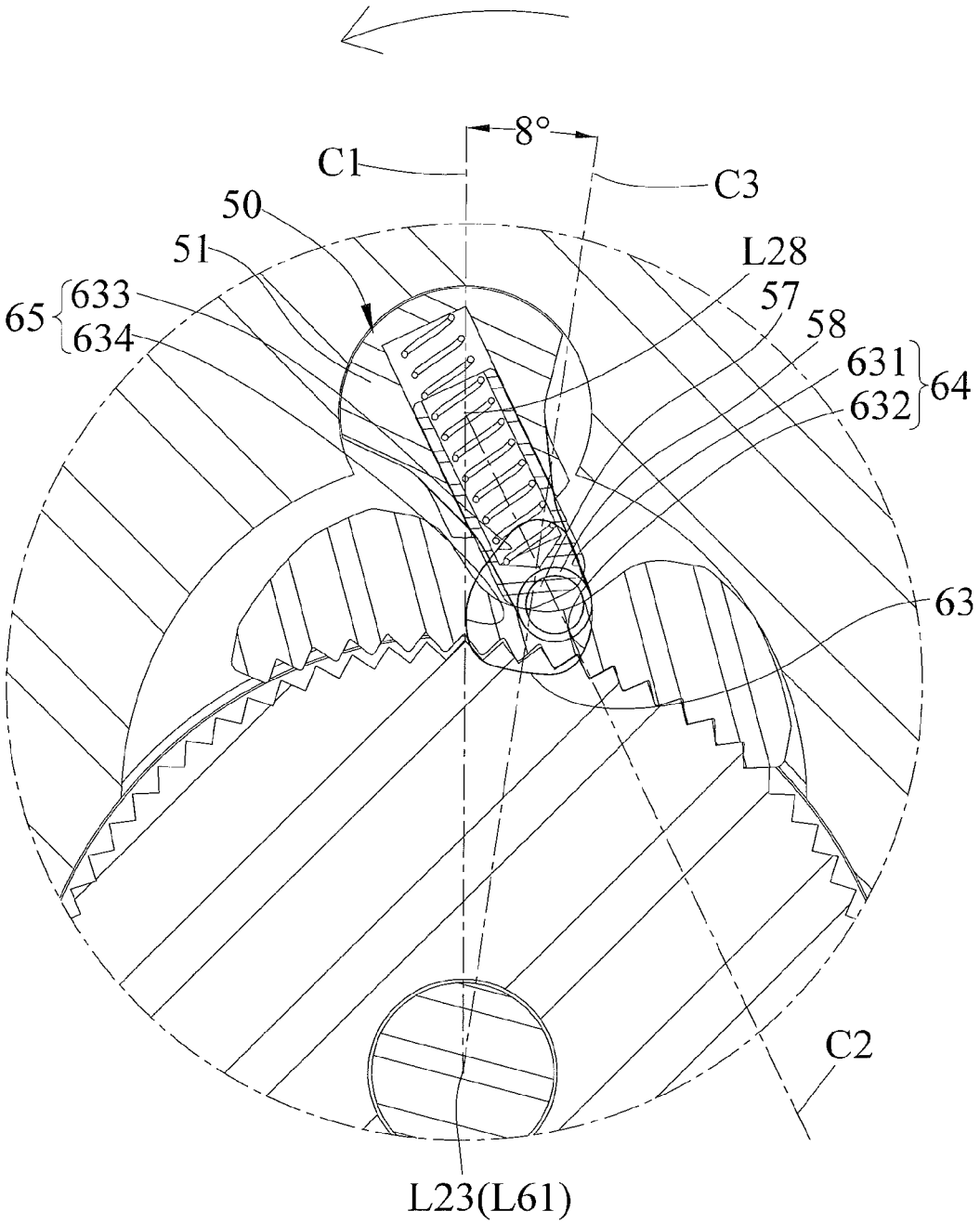
FIG. 7 shows a view similar to FIG. 6 with the control member rotated 5° relative to a body of the ratchet wrench.

FIG. 7 shows a view similar to FIG. 6, wherein control member 60 is rotated 5° relative to body 20. The angle between first and third reference lines C1 and C3 is 8°. Ring 58 of guide 57 rolls from first section 631 towards second section 632 of control groove 63. Specifically, ring 58 is now at an end of first section 631 adjacent pivotal portion 61 of control member 60. Angle θ between tangent T and second reference line C2 is still not larger than 45°.

Figure 8:
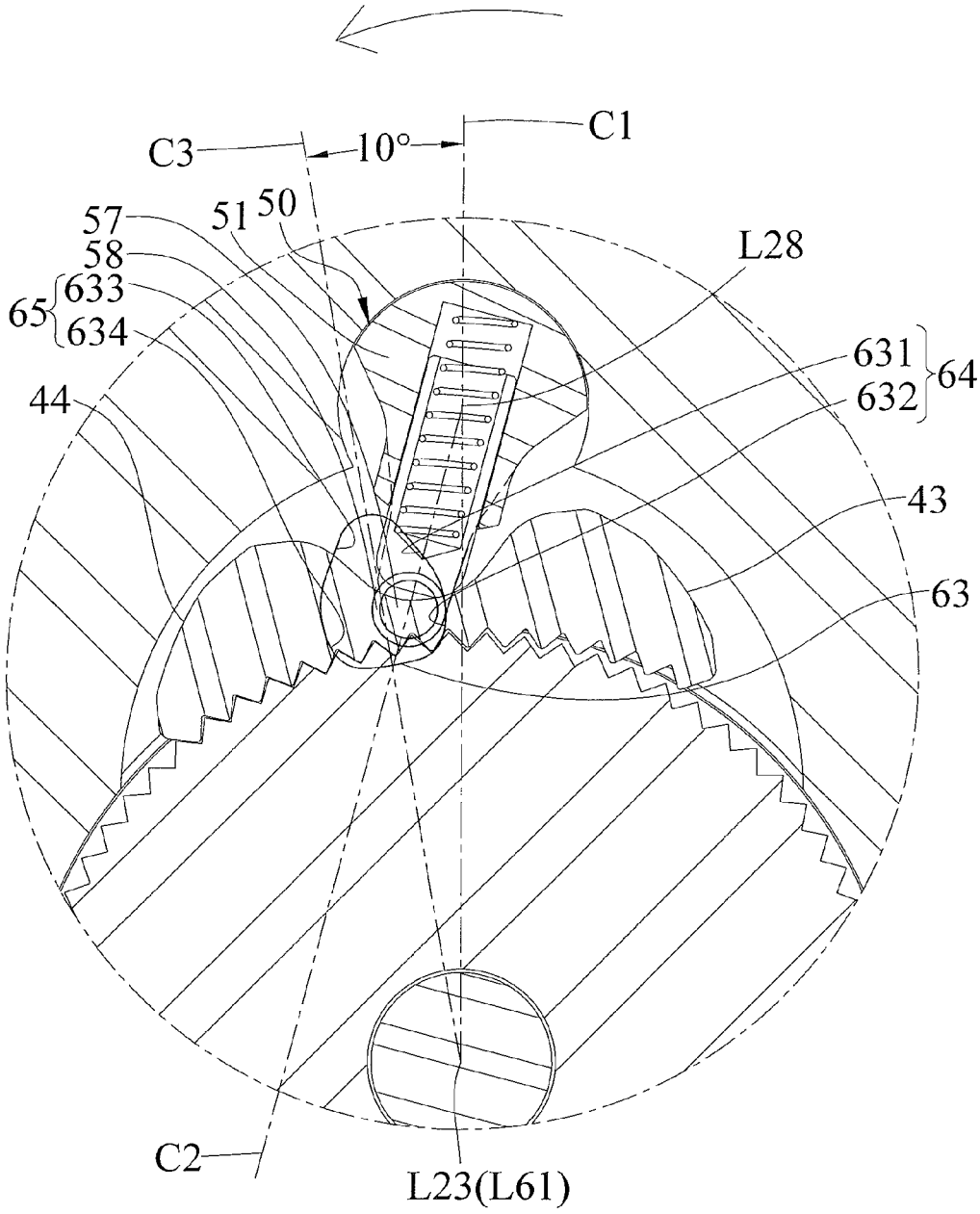
FIG. 8 shows a view similar to FIG. 6 with the control member rotated through 23° relative to the body.

FIG. 8 shows a view similar to FIG. 6, wherein control member 60 is rotated through 23° relative to body 20. The angle between first and third reference lines C1 and C3 is 10°. Ring 58 of guide 57 rolls along second section 632 of control groove 63 such that switch 50 actuates pawl 40 to slide in pawl groove 24. Thus, second sliding face 44 moves towards a peripheral wall of pawl groove 24, and first sliding face 43 moves away from the peripheral wall of pawl groove 24.

Figure 9:
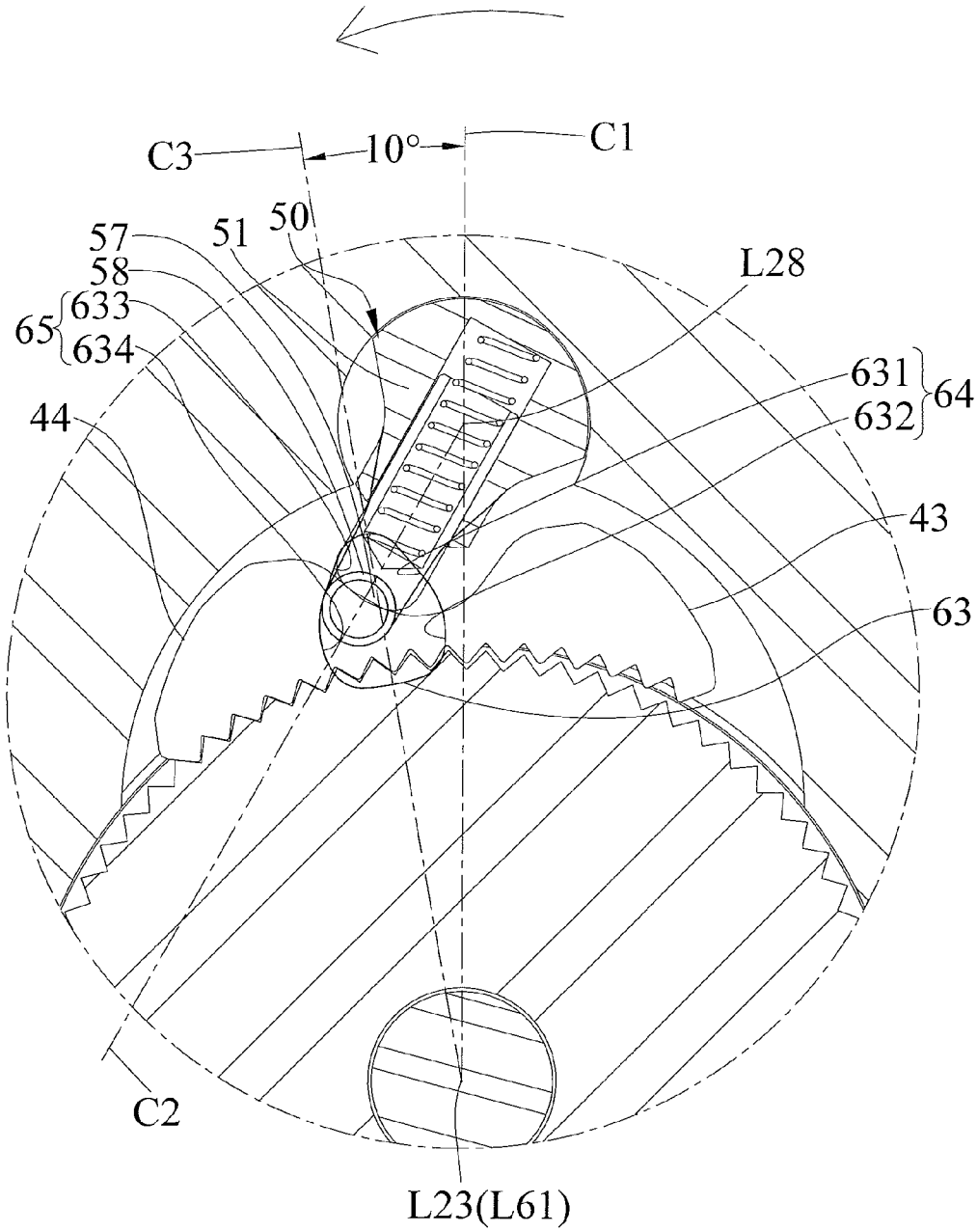
FIG. 9 shows a view similar to FIG. 14, illustrating automatic displacement of a switch.

Due to arrangement of elastic element 54 mounted between switch 50 and recessed portion 42 of pawl 40, pressing member 53 slides in recessed portion 42 under the returning action of elastic element 54 such that switch 50 rotates automatically to a position shown in FIG. 9. At the same time, ring 58 moves from second section 632 of first actuating portion 63 to third section 633 of second actuating portion 65. Specifically, ring 58 is now at an end of third section 633 adjacent pivotal portion 61 of control member 60. Furthermore, second sliding face 44 has not been in contact with the peripheral wall of pawl groove 24 yet.

Figure 10:
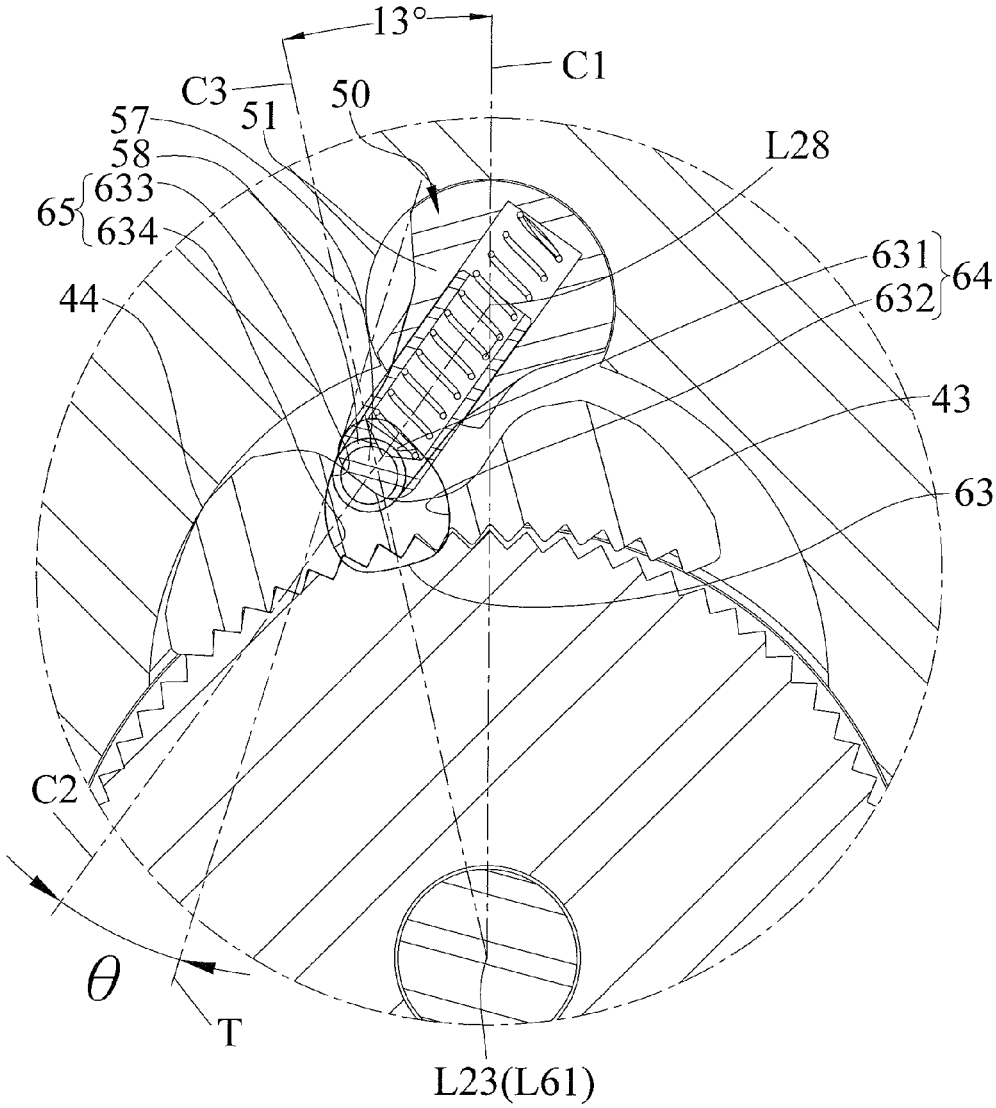
FIG. 10 shows a view similar to FIG. 9 with the control member in a second operative position.

Then, switch 50 continues to rotate in the same direction under the action of elastic element 54 until control member 60 is moved to and retained in the second operative position shown in FIG. 10. Second sliding face 44 is now in contact with the peripheral wall of pawl groove 24. During automatic rotation of switch 50, since guide 57 has been in contact with third section 633 of control groove 63, control member 60 is automatically positioned in the second operative position. Control member 60 has already rotated 26° relative to body 20. The angle between first and third reference lines C1 and C3 is 13°. Namely, control member 60 automatically rotates 3°. After control member 60 is positioned in the second operative position, pawl 40 is in a second engagement relationship with teeth 38 of drive member 30, wherein the other portion of inner, toothed face 41 of pawl 40 is engaged with teeth 38 of drive member 30, and the portion of inner, toothed face 41 of pawl 40 is disengaged from teeth 38 of drive member 30. In this state, handle 21 and drive member 30 can rotate jointly in the clockwise direction to drive the object in the clockwise direction. Furthermore, handle 21 can rotate freely in the counterclockwise direction relative to drive member 30 without driving the object. Note that angle θ between second reference line C2 and tangent T to the outer surface of guide 57 at the contact point between third section 633 and ring 58 of guide 57 is not larger than 45°.

Movement of control member 60 from the second operative position to the first operative position can easily and rapidly be achieved in a reverse manner with simple manual operation by operative portion 62 of control member 60. Control member 60 can be automatically positioned in either of the first and second operative positions while providing highly sensitive, immediate actuation of pawl 40 through switch 50.

Operation of ratchet wrench 10 of FIGS. 11-13 is substantially the same as ratchet wrench 10 of FIGS. 1-10 except the function of positioning member 70. Specifically, when control member 60 is in the first operative position, positioning portion 551 of switch 50 is received in first positioning groove 72. When control member 60 is in the second operative position, positioning portion 551 of switch 50 is received in second positioning groove 72. Since the spacing of returning portion 73 to pivoting axis L61 in the length direction of control member 60 is smaller than positioning grooves 72, returning portion 73 is deformed by positioning portion 551 in the length direction of control member 60 when positioning portion 551 is moving along returning portion 73 while control member 60 is moving between the first and second operative positions. Returning force of returning portion 73 of resilient positioning member 70 urges positioning portion 551 of switch 50 to move into one of positioning grooves 72. Thus, when control member 60 is released, control member 60 is moved to either of the first and second operative positions whichever is nearer. Positioning member 70 enhances the positioning effect of control member 60 in either of the first and second operative positions. Returning portion 73 provides an automatic positioning effect.

Now that the basic teachings of the present invention have been explained, many extensions and variations will be obvious to one having ordinary skill in the art. For example, inner face 601 of control member 60 does not have to include recess 66. Control groove 63 and retaining groove 67 can be directly formed in inner face 601 of control member 60. Guide 57 does not have to include ring 58. In this case, guide 57 can slide along first and second section 631 and 632 or along third and fourth section 633 and 634, depending upon the position of control member 60.

Ratchet wrenches 10 according to the teachings of the present invention provide direct transmission from control member 60 to pawl 40 and provide highly sensitive operation and reduce the risk of malfunction. Furthermore, ratchet wrenches 10 according to the preferred teachings of the present invention include fewer elements and, thus, have reduced manufacturing costs by provision of control groove 63 and guide 57 (with or without ring 58) providing positioning effect for control member 60. Furthermore, positioning member 70 is optionally mounted between control member 60 and switch 50 without the need of processing for forming positioning structure in body 20, further reducing the manufacturing costs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head and a handle interconnected to the head, with the head including a compartment having a first longitudinal axis, with a pawl groove defined in an inner periphery of the compartment, with the head further including a switch groove in communication with the pawl groove, with the switch groove having a second longitudinal axis parallel to and spaced from the first longitudinal axis of the compartment, with a first reference line extending from the compartment towards the switch groove, with the first reference line extending perpendicularly to the first longitudinal axis of the compartment and intersecting the second longitudinal axis of the switch groove;

a drive member rotatably received in the compartment about a rotating axis coincident to the first longitudinal axis of the compartment, with the drive member including a coupling section;

a pawl slideably received in the pawl groove between first and second positions respectively in first and second engagement relationships with the coupling section of the drive member;

a switch including a pivotal end rotatably received in the switch groove about a first pivoting axis coincident to the second longitudinal axis of the switch groove to control the first and second engagement relationships between the pawl and the coupling section of the drive member, with the switch further including an actuation end having a guide spaced from the first pivoting axis of the switch in a radial direction perpendicular to the first pivoting axis, with the guide having a third longitudinal axis parallel to and spaced from the first pivoting axis, with a second reference line extending from the actuation end towards the guide, with the second reference line extending perpendicularly to the first pivoting axis and intersecting the third longitudinal axis of the guide; and a control member including a pivotal portion rotatable relative to the head and pivotable between first and second operative positions about a second pivoting axis coincident to the rotating axis, with the control member further including a control groove spaced from the second pivoting axis in a length direction of the control member perpendicular to the second pivoting axis, with the guide of the switch slideably received in the control groove, with the first and second engagement relationship between the pawl and the coupling section of the drive member being controlled by moving the control member between the first and second operative positions through sliding movement of the guide in the control groove that causes pivotal movement of the switch about the first pivoting axis, with the control member defining a third reference line extending from the pivotal portion towards the control groove, with the third reference line extending perpendicularly to the second pivoting axis of the control member and passing through a center of the control groove, with the control groove including first and second actuating portions on opposite sides of the third reference line, wherein when the control member is in the first operative position, the pawl is in the first engagement relationship with the coupling section of the drive member, allowing the handle and the drive member to rotate in a first direction driving an object in the first direction, and allowing the handle to rotate freely relative to the drive member in a second direction reverse to the first direction without driving the object, with the guide of the switch having an outer surface contacting the first actuating portion at a first contact point, with a first tangent to the outer surface of the guide at the first contact point having a first angle not larger than 45° relative to the second reference line, and wherein when the control member is in the second operative position, the pawl is in the second engagement relationship with the coupling section of the drive member, allowing the handle and the drive member to rotate in the second direction driving the object in the second direction, and allowing the handle to rotate freely relative to the drive member in the first direction without driving the object, with the outer surface of the guide of the switch contacting the second actuating portion at a second contact point, with a second tangent to the outer surface of the guide at the second contact point having a second angle not larger than 45° relative to the second reference line.

2. The ratchet wrench as claimed in claim 1, with the guide of the switch including a cylindrical peg and a ring rotatably mounted around the peg, with the ring providing relative smooth movement between the control member and the switch.

3. The ratchet wrench as claimed in claim 1, with each of the first and second angles being in a range of 18°-28°.

4. The ratchet wrench as claimed in claim 1, with the first and second actuating portions being symmetric to each other relative to the third reference line, with the first actuating portion including a rectilinear first section and an arcuate second section contiguous to the first section, with the first section having a first spacing to the second pivoting axis along the third reference line larger than the second section, with the second actuating portion including a rectilinear third section and an arcuate fourth section contiguous to the third section, with the third section having a second spacing to the second pivoting axis along the third reference line larger than the fourth section, with the first contact point being located between the first section of the first actuating portion and the guide of the switch when the control member is in the first operative position, with the second contact point being located between the third section of the second actuating portion and the guide of the switch when the control member is in the second operative position.

5. The ratchet wrench as claimed in claim 4, with the first and third sections having decreasing spacings therebetween away from the second pivoting axis, with the second and fourth sections having decreasing spacings therebetween away from the second pivoting axis.

6. The ratchet wrench as claimed in claim 5, with the spacings between the first and third sections smaller than the spacings between the second and fourth sections.

7. The ratchet wrench as claimed in claim 1, with the control member further including an operative portion spaced from the pivotal portion along the third reference line, with the operative portion adapted to be manually operated by a user, with the control member further including inner and outer faces extending between the pivotal portion and the operative portion of the control member, with the inner face located intermediate the outer surface and the head along the second pivoting axis, with the control groove formed in the inner surface, with the third reference line being a dividing line of the control groove and separating the control groove into two portions symmetric to each other relative to the dividing line.

8. The ratchet wrench as claimed in claim 7, with the control member including a recess formed in the inner face and having a bottom face, with the control groove formed in the bottom face of the recess, with the actuation end of the switch received in the recess.

9. The ratchet wrench as claimed in claim 8, further comprising, in combination: a resilient positioning member mounted in the recess, with the positioning member including first and second positioning grooves, with the actuation end of the switch including a positioning portion extending along the first pivoting axis of the switch, with the positioning portion selectively and releasably engaged in one of the first and second positioning grooves corresponding to the first and second operative positions of the control member for positioning the control member in one of the first and second operative positions.

10. The ratchet wrench as claimed in claim 9, with the positioning member further including a returning portion intermediate the first and second positioning grooves, with the returning portion having a spacing to the second pivoting axis along the length direction of the control member smaller than the first and second positioning grooves, with the positioning portion moving along the returning portion and causing deformation of the returning portion in the length direction of the control member when the control member is moving between the first and second operative positions, with the returning portion urging the positioning portion to move into one of the first and second operative positions when the control member is released.

11. The ratchet wrench as claimed in claim 10, with the control member further including a retaining groove formed in the bottom face of the recess and having two side walls each having a notch, with the control groove intermediate the retaining groove and the second pivoting axis in the length direction of the control member, with the positioning member including two ends engaged in the notches, with the first and second positioning grooves intermediate the two ends of the positioning member.

12. The ratchet wrench as claimed in claim 11, with the positioning member being a resilient metal strip, with the positioning portion being a cylindrical stub coaxially extending from the first pivoting axis of the switch, with each of the first and second positioning grooves being semi-circular in cross section.

13. The ratchet wrench as claimed in claim 12, with the pivotal end of the switch including a receptacle extending perpendicularly to the first pivoting axis of the switch, with a pressing member and an elastic element received in the receptacle, with the pawl including an inner, toothed face having first and second portions selectively and releasably engaged with the coupling section of the drive member, with the pawl further including an outer face opposite to the toothed face, with a recessed portion formed in the outer face of the pawl, with the recessed portion having first and second sides, wherein when the control member is in the first operative position, the pressing member is biased by the elastic element to press against the first side of the recessed portion to engage the first portion of the toothed face of the pawl with the coupling section of the drive member, the second portion of the toothed face is disengaged from the coupling section of the drive member, wherein when the control member is in the second operative position, the pressing member is biased by the elastic element to press against the second side of the recessed portion to engage the second portion of the toothed face of the pawl with the coupling section of the drive member, the first portion of the toothed face of the pawl is disengaged from the coupling section of the drive member.

14. The ratchet wrench as claimed in claim 13, with the head including first and second sides spaced along the first longitudinal axis, with the compartment extending from the second side towards but spaced from the first side, with the first side including a hole in communication with the compartment, with the first side of the head including the pawl groove, with the drive member further including an engaging portion extending from an end of the coupling section, with the engaging portion having a portion extending beyond the head via the hole, with a drive column extending from another end of the coupling section beyond the second side of the head, with the pivotal portion of the control member rotatably mounted to the portion of the engaging portion beyond the head.

15. The ratchet wrench as claimed in claim 1, with the third reference line having an angle in the order of 13° relative to the first reference line when the control member is in either of the first and second operative positions.

* * * * *